US005098167A

United States Patent [19]

Latham

[11] Patent Number: 5,098,167

[45] Date of Patent: Mar. 24, 1992

[54] TOOL BLOCK WITH NON-ROTATING, REPLACEABLE WEAR INSERT/BLOCK

[76] Inventor: Winchester E. Latham, 10470 W. 21st St., Indianapolis, Ind. 46234

[21] Appl. No.: 591,372

[22] Filed: Oct. 1, 1990

[51] Int. Cl.[5] ..... E21C 35/18

[52] U.S. Cl. ..... 299/86; 299/81

[58] Field of Search ..... 299/79, 86, 91, 92, 299/85, 87; 175/354; 411/178

[56] References Cited

U.S. PATENT DOCUMENTS

| | | | |
|---|---|---|---|
| 2,227,209 | 12/1940 | Zublin | 175/354 X |
| 3,512,838 | 5/1970 | Kniff | 299/86 |
| 4,302,053 | 11/1981 | Roepke et al. | 299/86 |
| 4,480,873 | 11/1984 | Latham | 299/87 |
| 4,697,850 | 10/1987 | Tuneblom | 299/87 |

FOREIGN PATENT DOCUMENTS

| | | | |
|---|---|---|---|
| 1102568 | 2/1968 | United Kingdom | 299/92 |

*Primary Examiner*—David J. Bagnell
*Attorney, Agent, or Firm*—Locke Reynolds

[57] ABSTRACT

A sleeve for containing a rotary driven cutter bit for use on a roadway surface reclaiming machine in a removable manner is disclosed which aids in protecting the tooth-holding block from abrasion by threading a sleeve into the block in such a manner that contact during use by abrasive material with the sleeve tightens the connection between the block and the sleeve, such that abrasion between the confronting surfaces of the block and the sleeve is decreased and the useful life is increased. In addition, the sleeves allow for simple, efficient replacement of a damaged cutting tool or sleeve in the reclaiming machine.

9 Claims, 2 Drawing Sheets

TOOL BLOCK WITH NON-ROTATING, REPLACEABLE WEAR INSERT/BLOCK

BACKGROUND OF THE INVENTION

The present invention is directed generally to rotary driven cylindrical cutters and scarifiers for use in earthworking, mining, or other in situ disintegration of hard materials. The invention is particularly directed to such rotary driven cylindrical cutters and scarifiers which have the tool blocks mounted directly onto the flighting or directly to the surface of the cylindrical cutter.

The invention has particular utility in connection with cutting bits and blocks. Examples of the prior art are to be found in Kniff U.S. Pat. No. 3,820,848; Kniff U.S. Pat. No. 3,830,546; Kniff et al U.S. Pat. No. 3,841,707; Wrulich et al. U.S. Pat. No. 4,159,746; Wrulich et al. U.S. Pat. No. 4,247,150; Krekeler U.S. Pat. No. 4,337,980; LeBegue et al. U.S. Pat. No. 4,299,424; Latham U.S. Pat. No. 4,480,873; Penkunas et al. U.S. Pat. No. 4,725,099.

In general, the construction blocks disclosed in the prior art includes a recess to accept a rotary mining or construction tool. Tool bits are removably mounted within the recesses in such a way that the edge of the tool bit projects outward beyond the side of the tool block. The projection of the tool bit causes it to rotate in the recess of the construction blocks. Sometimes a rotating wear guard may be incorporated with the tool bit or the construction block.

In use, the abrasive forces, which often include sudden rather high value shocks, are transmitted from the cutting bits into the construction blocks. The forces frequently become large enough to wear the recess of the construction blocks. The recess becomes too large to hold the cutting bit, causing the machine to be stopped for construction block replacement. Also, when the tooth does break off, the seat of the block is wiped out. The repair and replacement of the tool block member damaged in either manner typically necessitates the use of a cutting torch to remove construction blocks and a welder to replace the construction in the field. This time-consuming repair job results in considerable expense to the road-mining machine operator for down time and labor. Missalignment of the support block results in undersirable lateral forces on a new cutting bit which in turn results in very fast wear and ultimate failure of the replaced parts.

SUMMARY OF THE INVENTION

A rotary driven cutter of the present invention is generally comprised of a driven rotatable member such as a drum which is motorized. A plurality of cutter bits are attached to the member or drum through the combination of drum-mounted blocks or flighting sections and insert sleeves inserted between the blocks or flighting and the cutter bits. The cutter bits contact the workface as the drum is rotated to disfigure and dislodge material therefrom, which material is of an abrasive character.

The present improvement is intended to avoid many of the difficulties of the prior art by constructing the drum-mounted construction block and tool holders to have particularly advantageous features. The wear insert sleeve inserted between the block and the cutter bit has a right or left threaded outside perimeter depending upon its location on the rotatable drum. The construction block consists of a threaded recess that will accept the wear insert. The construction block is affixed by welding to the cutting drum. Each wear insert includes a bore which receives a typical tungsten carbide-tipped cutting bit. Each of the cutting bits generally projects outward beyond the surface of the construction block containing the recesses, and in this manner presents wear points or wear surfaces to be acted upon by the abrasive mind asphaltic road material. When the drum is rotated, the abrasive material predominantly contacts only one side of each cutter bit and insert sleeve, based on its location on the drum, which acts as a rotating force on both the cutter bit and insert sleeve. This natural rotation caused by the repeated contact with the abrasive material with each turn of the drum serves to ensure that the sleeve is tightly received into the block or flighting. In relation to the rotation of the drum, insert sleeves that point to the right would have left hand threads and those pointing to the left would have right hand threads. The insert may be placed directly into the flighting making it a block.

In use, the cutting bits will vibrate or otherwise move with respect to the tool holders just as in the prior art, which will ultimately result in loss of retention of the cutting bit and necessitate replacement of the insert sleeve. This replacement is easily achieved by the removal of the threaded wear insert and inserting a new wear insert. The replacement of the worn insert is simplified in that a gripping surface is provided between the construction block and the cutting bit. Substantially all the wear on the worn insert being replaced occurs between the cutting bit and the insert. The continuous tightening action of the contact between the threaded sleeve and the abrasive material eliminates any opportunity for wear between the insert and the block thus increasing the useful life of the blocks or flighting to which the threaded sleeve is engaged.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures.

DESCRIPTION OF THE PREFERRED EMBODIMENT

Figure 1:
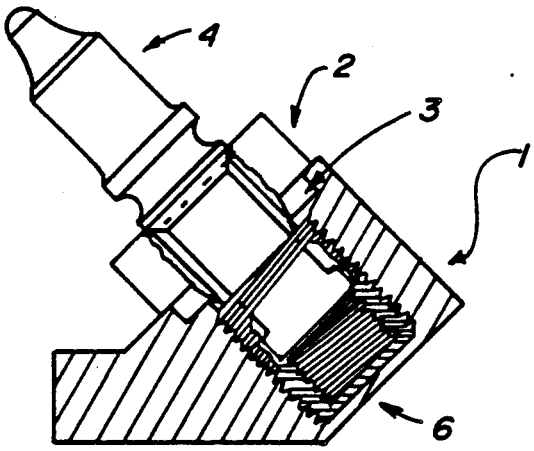
FIG. 1 is a diagrammatic view of a block, threaded insert and cutting bit according to this invention.

FIG. 1 is a cross section of the construction block 1, and shows the wear insert 2 and cutting bit 4. The shoulder of the insert 2 rests against the seat of the construction block 1; this would keep the threads from being under shock load of the cutting operation. The recess 6 of the construction block 1 is threaded either with right or left hand threads depending upon the location of the block 1 on the drum to which the block is mounted.

Figure 2:
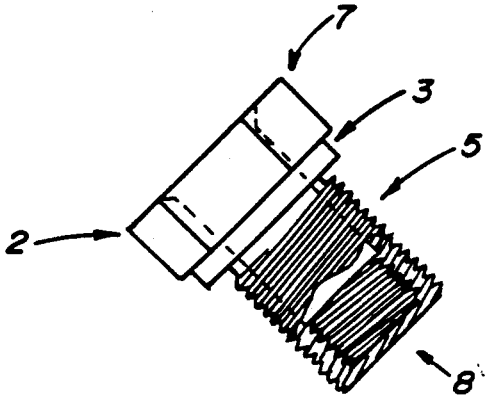
FIG. 2 is a diagrammatic view of a threaded insert according to this invention.

FIG. 2 is the threaded insert 2. This may be placed in the construction block such as that shown in FIG. 1 or directly into the drum flighting. The insert has right or left hand threads 5. The gripping surface 7 allows for easy access for removal of the insert. Insert material is never welded and therefore maintains its hardness. The lower portion 8 of the inside of the insert is threaded in the opposite direction. This allows for easy removal of the insert if the gripping 7 is wiped out.

Figure 3:
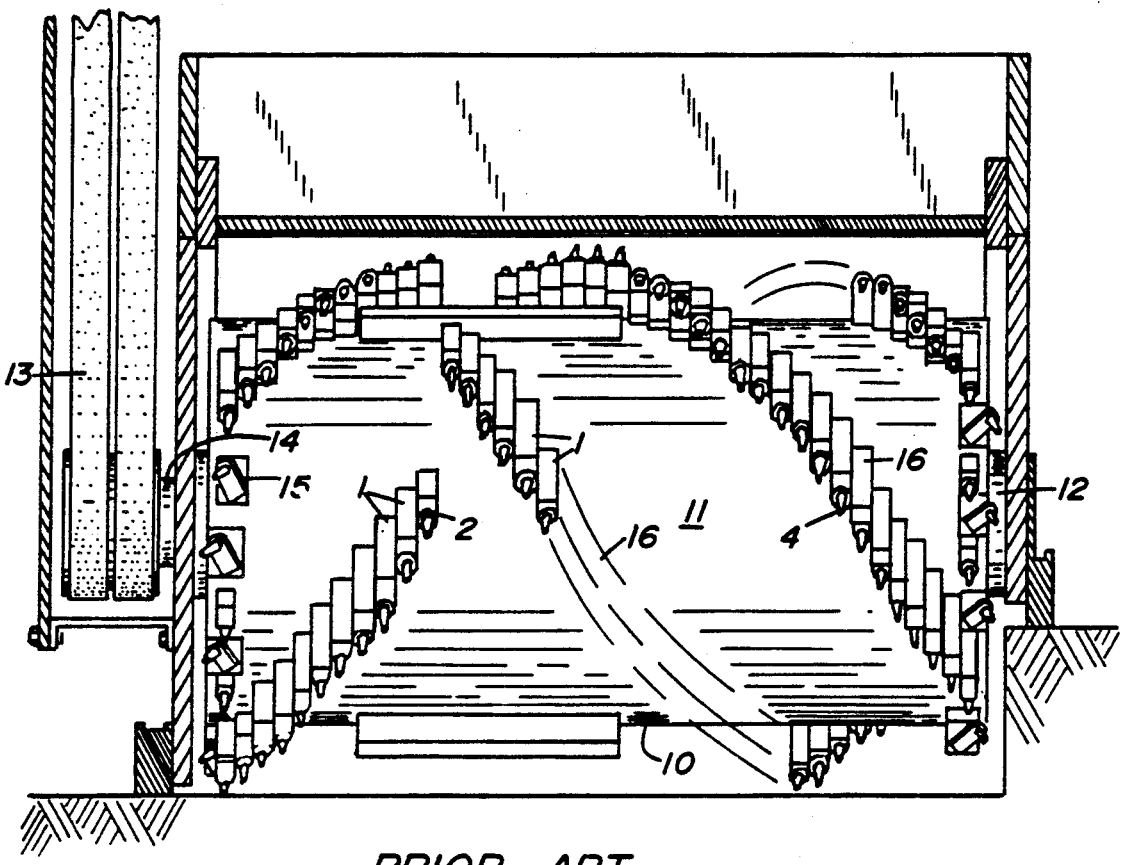
PRIOR ART FIG. 3
FIG. 3 is a front view of a rotatable cutter drum on which the invention can be employed.

In accordance with the present invention, blocks 1 with wear inserts 2 having intergaging threads of selected direction can be used on a rotatable cutter drum 10 as shown generally in FIG. 3. The rotatable cutter drum 10 includes a cylinder 11 supported generally at both ends by an appropriate support means 12 and driven for rotation by a belts 13 through stub shafts 14 in a manner similar to that shown in U.S. Pat. No. 4,697,850. The blocks 1 are fixed to the drum 10 either as single working elements 15 or in relation to each other so as to form a line of flighting 16. The rotation of the drum 10 shown in FIG. 3 is such that, the upper portion of the drum 10 moves out of the plane of the paper and downward toward the bottom of the drum. It will be seen that with this motion taking place, the flighting 16 acts to drive material located near the right side of the drum toward the left. Likewise, the flighting 16 on the left side of the drum acts to drive material toward the right.

In both cases the material mined from the road surface will selectively contact only a portion of the wear insert 2 causing the wear insert to experience a rotating force or torque which will be different on opposite sides or ends of the drum. That is, the contact with the abrasive material on the right side of the drum shown in FIG. 3 will cause the wear inserts 2 and cutting bits 4 to experience a clockwise rotational force. On the other hand, the contact with the abrasive material on the left side of the drum 10 will cause the wear inserts 2 and cutting bits 4 to experience a counter-clockwise rotational force. By selectively threading the blocks 1 and wear inserts 2 based on their position on the drum, the rotational forces can ensure tight non-rotating engagement between the inserts 2 and blocks 1 thereby minimizing any need for replacement of the blocks 1 which are fixed to the drum 10.

Figure 4:
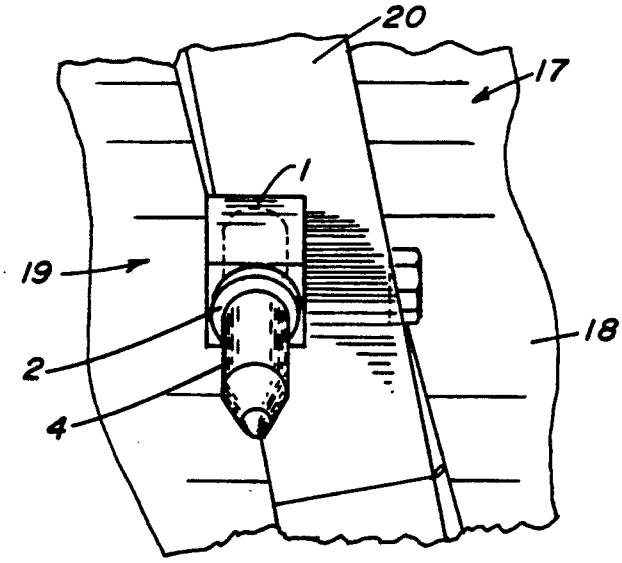
PRIOR ART FIG. 4
FIG. 4 is a front view of an alternative rotatable cutter drum on which the invention can be employed.

Likewise, wear inserts 2 having intergaging threads of selected direction in accordance with the present invention can be used on a rotatable cutter drum 17 as shown generally in FIG. 4. The rotatable cutter drum 10 includes a cylinder 18 supported generally at both ends by an appropriate support means, and driven for rotation by drive means, not shown, through stub shafts in a manner similar to that shown in U.S. Pat. No. 4,480,873. The drum 17 includes flighting sections 20 which can directly receive the selectively threaded wear inserts 2. Alternatively the selectively threaded wear inserts 2 can be secured into blocks 1 which are received in recesses 19 in the flighting. In both cases the material mined from the road surface will selectively contact only a portion of the wear insert 2 causing the wear insert to experience a rotating force or torque which will be different on opposite sides or ends of the drum 17 as previously discussed. By employing the selectively threaded wear inserts 2 based on their position on the drum, the rotational forces can ensure tight non-rotating engagement between the inserts 2 and either the blocks 1 or the flighting 20 thereby minimizing any need for replacement of the blocks or flighting.

Although the invention has been described in detail with reference to preferred embodiments, variations and modifications exist within the scope and spirit of the invention as described and as claimed in the following claims.

What is claimed is:

1. An apparatus for use on a roadway surface reclaiming machine, comprising:

a driven rotatable member having an outer surface for confronting a workface, a plurality of tool-holding elements distributed over and fixed to the driven member outer surface, a first portion of said plurality of elements including an opening having a right-threaded interior surface, and a second portion of said plurality of elements including an opening having a left-threaded interior surface, a like plurality of sleeves, each sleeve having either a right or left threaded exterior surface engaged in one of the tool-holding elements, and a like plurality of cutter bits, each cutter bit including a rearmost section having a length no greater than the length of the sleeves and wholly received in one of the plurality of sleeves, for rotation with the driven member to cut abrasive material from the workface, said first and second portions of the plurality of tool-holding elements being situated on the driven member surface such that when the driven member is rotated, passing abrasive material predominantly contacts only one side of each sleeve causing a tightening of the threaded engagement between each sleeve and the corresponding tool-holding element, thereby increasing the useful life of the tool-holding elements.

2. An apparatus as described in claim 1 further comprising flighting fixing the tool-holding elements to the driven member outer surface.

3. An apparatus as described in claim 1 where the tool-holding elements comprise blocks mounted to the driven member outer surface.

4. An apparatus as described in claim 1 where each sleeve includes a lower interior surface threaded in the opposite direction from the threaded exterior surface of the sleeve for allowing easy removal of the sleeve.

5. In apparatus for use on a roadway surface reclaiming machine, including a driven rotatable member having an outer surface for confronting a workface, a plurality of tool-holding elements fixed to the driven member outer surface, and a like plurality of cutter bits, each cutter bit including a rearmost section of a selected length inserted into an opening in one of the plurality of tool holding elements for rotation with the driven member to cut abrasive material from the workface, the plurality of tool-holding elements being distributed over the driven member surface such that when the driven member is rotated, passing abrasive material predominantly contacts only one side of each tool holding element, the improvement comprising:

said openings in a first portion of said tool-holding elements having a right-threaded interior surface, and said openings in a second portion of said tool-holding elements having a left-threaded interior surface, a like plurality of sleeves inserted into the tool-holding element openings and receiving said cutter bits, each sleeve having a length sufficient to wholly receive and maintain the entire rearmost section of the cutter bit separate from the tool holding element to prevent abrasive wear of the tool holding element, and each sleeve selectively having either a right or left threaded exterior surface engaged with the threaded interior surface of the corresponding tool-holding element, the first and second portions of the plurality of tool-holding elements being situated on the driven member surface such that when the driven member is rotated, passing abrasive material predominantly contacts only one side of each sleeve causing a tightening of the threaded engagement between each sleeve and the corresponding tool-holding element to inhibit the intrusion of abrasive material between the sleeve and corresponding tool-holding element, thereby increasing the useful life of the tool-holding elements.

6. The improvement of claim 5 further comprising flighting fixing the tool-holding elements to the driven member outer surface.

7. The improvement of claim 5 where the tool-holding elements comprise blocks mounted to the driven member outer surface.

8. The improvement of claim 5 where each sleeve includes a lower interior surface threaded in an opposite direction from the threaded exterior surface of the sleeve for allowing easy removal of the sleeve.

9. An apparatus for use on a roadway surface reclaiming machine, comprising:

a driven rotatable member having an outer surface for confronting a workface, a plurality of tool-holding elements distributed over and fixed to the driven member outer surface, a first portion of said plurality of elements including an opening having a right-threaded interior surface, and a second portion of said plurality of elements including an opening having a left-threaded interior surface, a like plurality of sleeves, each sleeve having either a right or left threaded exterior surface engaged in one of the tool-holding elements, and a lower interior surface threaded in the opposite direction from the threaded exterior surface of the sleeve for allowing easy removal of the sleeve from the tool-holding element it which it is engaged, a like plurality of cutter bits, each cutter bit including a rearmost section wholly received in one of the plurality of sleeves, for rotation with the driven member to cut abrasive material from the workface, said first and second portions of the plurality of tool-holding elements being situated on the driven member surface such that when the driven member is rotated, passing abrasive material predominantly contacts only one side of each sleeve causing a tightening of the threaded engagement between each sleeve and the corresponding tool-holding element, thereby increasing the useful life of the tool-holding elements.

* * * * *